US007434956B2

(12) United States Patent
Mattheis

(10) Patent No.: US 7,434,956 B2
(45) Date of Patent: Oct. 14, 2008

(54) DUAL SWITCH HANDHELD FLASHLIGHT

(76) Inventor: Steven Mattheis, P.O. Box 4203 135 N. Gros Ventre, Jackson, WY (US) 83001

( * ) Notice: Subject to any disclaimer, the term of this patent is extended or adjusted under 35 U.S.C. 154(b) by 69 days.

(21) Appl. No.: 11/512,492

(22) Filed: Aug. 30, 2006

(65) Prior Publication Data

US 2008/0055891 A1 Mar. 6, 2008

(51) Int. Cl.
*F21L 4/04* (2006.01)

(52) U.S. Cl. ..... 362/205; 362/157; 362/202; 362/206

(58) Field of Classification Search ..... 362/157, 362/200, 202, 205, 206
See application file for complete search history.

(56) References Cited

U.S. PATENT DOCUMENTS

| | | | | |
|---|---|---|---|---|
| 2,530,913 | A | 11/1950 | Shackel | |
| 2,983,812 | A | 5/1961 | Ashe | |
| 4,502,102 | A | 2/1985 | Phipps | 362/183 |
| 4,823,242 | A | 4/1989 | Maglica et al. | 362/187 |
| 5,121,308 | A | 6/1992 | Maglica et al. | 362/187 |
| 5,138,538 | A | 8/1992 | Sperling | 362/205 |
| 6,670,874 | B1 * | 12/2003 | Galli | 335/205 |
| 6,814,466 | B2 | 11/2004 | Parsons et al. | 362/205 |
| 2005/0007768 | A1 * | 1/2005 | Holder et al. | 362/157 |
| 2005/0122712 | A1 * | 6/2005 | Kim | 362/184 |
| 2005/0122714 | A1 | 6/2005 | Matthews et al. | 362/206 |

* cited by examiner

*Primary Examiner*—Sandra L. O'Shea
*Assistant Examiner*—Meghan K. Dunwiddie
(74) *Attorney, Agent, or Firm*—Westman, Champlin & Kelly P.A.

(57) ABSTRACT

A handheld flashlight includes a main body with a first and second end which also includes a power source within the main body. A light emitting source is attached to the main body proximate the first end. The main body includes a first switch operably attached to the main body proximate a second end and a second switch operably attached to the main body between the first end and the second end. The handheld flashlight includes circuitry within the main body that contains the first and second switches and connects the power source to the light emitting source through either the first switch or the second switch or both the first and second switches such that either the first or second switch can be manipulated independent of the position of the other switch to provide power to the light emitting source or interrupt power to the light emitting source.

17 Claims, 3 Drawing Sheets

DUAL SWITCH HANDHELD FLASHLIGHT

BACKGROUND OF THE INVENTION

The present invention relates to a handheld flashlight. More particularly, the present invention relates to a handheld flashlight having two switches that operate independently of each other for energizing a light emitting source.

Most flashlights typically have a body constructed of a conductive material that houses at least one dry cell battery where the body is utilized as the ground for a circuit that provides power to a light emitting source. When the body is constructed of a non-conductive material, a wire is typically contained within the body that completes the circuit by forming the ground.

A typical flashlight includes an on/off switch near a flashlight head that contains the light emitting source. A typical flashlight switch interrupts the electrical path between the battery and the flashlight body or ground wire to de-energized light emitting source. The switch also connects the battery with the flashlight body or ground wire to energize the light emitting source.

Typically, a person using the flashlight will manipulate the position of the switch with his/her thumb. When the person's hand is at or below shoulder level, the thumb is naturally positioned near the switch near the flashlight head which makes the typical flashlight configuration convenient in some applications.

However, when the person's hand is positioned above shoulder level, the person's grip on the flashlight typically changes such that the thumb is positioned near the tail end of the flashlight which makes manipulating the side switch near the flashlight head impractical. A switch located at the tail end of the flashlight body would be convenient when the flashlight is utilized above the shoulder level of the person using the flashlight.

A typical circuit configuration utilizing the body as a ground would not be capable of utilizing a switch near the light emitting source and a switch in the tail end of the flashlight. Therefore, a typical one switch flashlight, that utilizes the main body of the flashlight as an electrical conduit, is not practical for all applications.

SUMMARY OF THE INVENTION

The present invention includes a handheld flashlight having a main body with a first and second end. A power source is positioned within a cavity in the main body and a light emitting source is attached to the main body proximate the first end. The handheld flashlight also includes a first switch operably attached to the main body proximate the light emitting source and a second switch attached to the main body at the second end. Circuitry within the main body contains the first switch and the second switch and connects the power source to the light emitting source through either the first switch or the second switch or both the first switch and the second switch such that either the first switch or the second switch can be manipulated independent of the position of the other switch to provide power to the light emitting source or interrupt power to the light emitting source.

DETAILED DESCRIPTION OF ILLUSTRATIVE EMBODIMENTS

Figure 1:
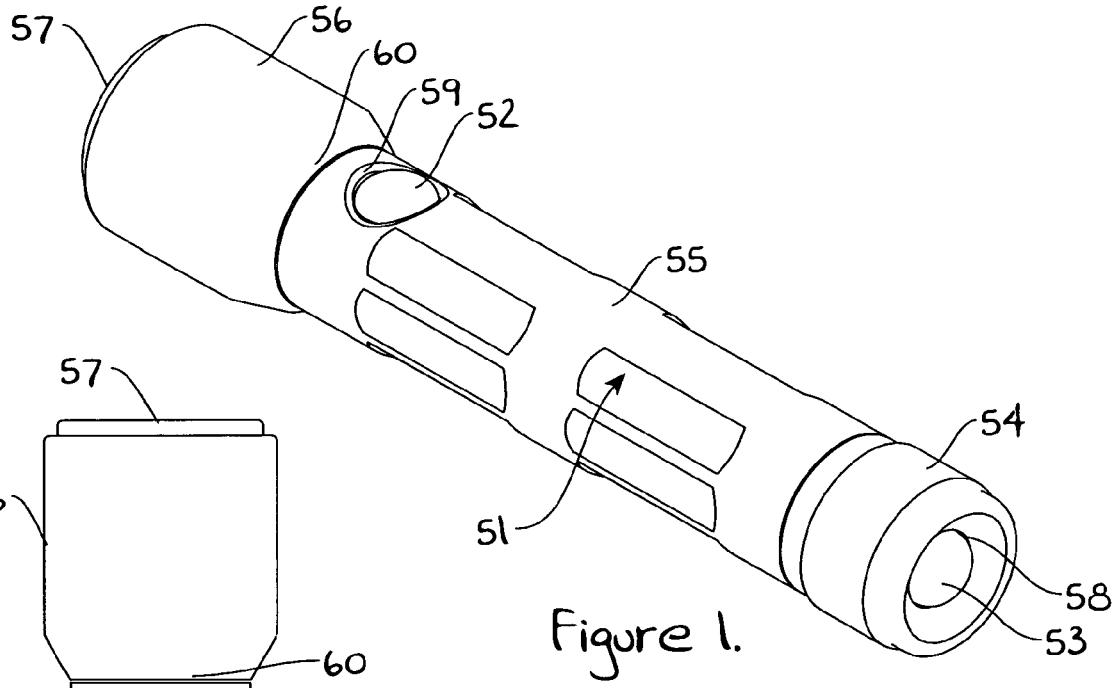
FIG. 1 is a perspective view of a dual switch flashlight of the present invention.
Figure 2:
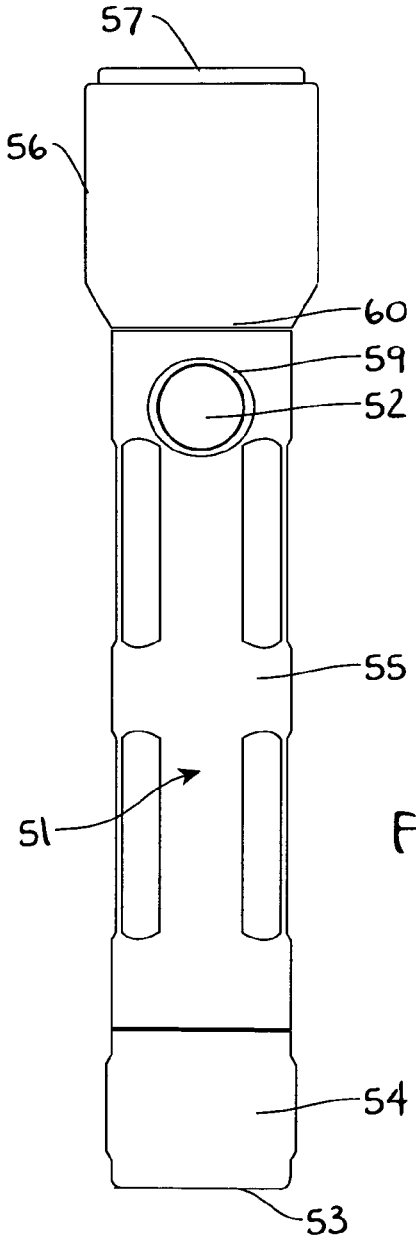
FIG. 2 is a top view of the dual switch flashlight of the present invention.

A dual switch flashlight of the present invention is generally illustrated in FIG. 1 at 51. The dual switch flashlight 51 includes a side switch 52 positioned within an aperture 59 in the main body 55 proximate a proximal end 60. The flashlight 51 also includes a tail switch 53 positioned within an aperture 58 in a tail cap 54 that attaches to a distal end 61 of the main body 55. The flashlight 51 includes circuitry that allows a user of the flashlight 51 energize or de-energize a light source 57 by manipulating either the side switch 52 or the tail switch 53 independent of the position of the other switch.

A head 56 that contains the light source 57 is attached to the main body 55, typically with a threaded engagement. However, the head 56 may also be fixedly attached to the proximal end 66 of the main body 55 or removably attached to the main body with other attaching mechanisms. The head 56 typically includes a reflector which directs the light from the light source 57 through a lens and in a direction typically away from the flashlight 51.

Figure 3:
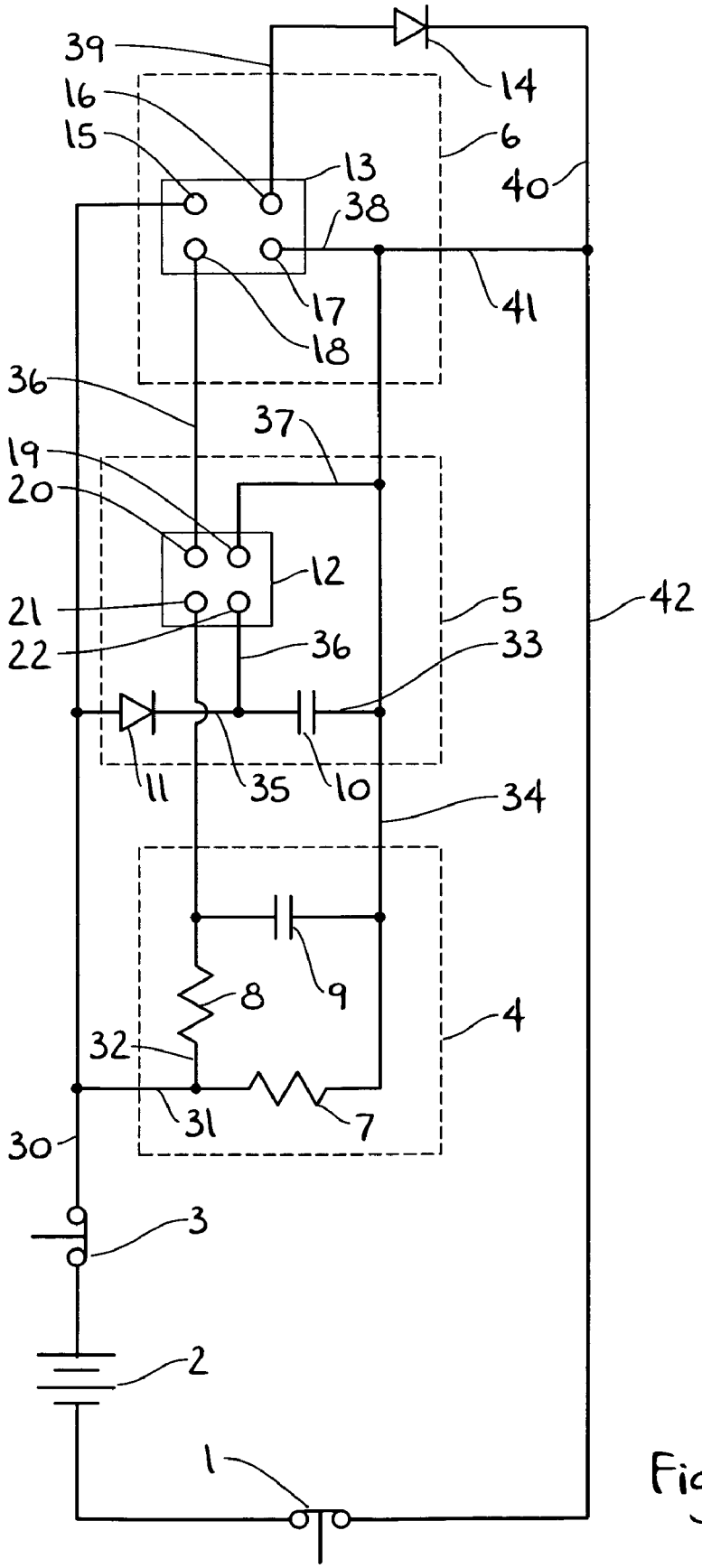
FIG. 3 is a circuitry diagram for the dual switch flashlight of the present invention.

Referring to FIG. 3, the circuitry within the flashlight includes a power source 2 that supplies power to a light source 14 by manipulating either the tail switch 1 or the side switch 3 independent of the position of the other switch. The circuitry includes logic circuitry 5 that supplies a signal to switching circuitry 6 that provides or interrupts power to the light source 14.

The circuitry also typically includes a filter 4 positioned between the switches 1 and 3 and the logic circuitry 5. While not necessary, the filter 4 is desirable because the filter 4 prevents the logic circuitry 5 from detecting an inadvertent engagement, or bounce, of either the tail switch 1 or the side switch 3 after either switch 1 or 3 has been depressed with manual force and then released.

Typically, both the tail switch 1 and the side switch 3 are normally closed momentary switches where depressing either switch 1 or 3 interrupts power to the logic circuitry 5 which then causes the logic circuitry 5 to react to the interruption of power. Because both switches 1 and 3 interrupt power to the logic circuitry which causes the logic circuitry 5 to energize or de-energize the light source 14, the filter 4 is typically included in the circuitry to prevent an undesired bounce from either switch 1 or 3 from energizing or de-energizing the light source 14.

Power is supplied to the filter 4 through a wire 31 which connects to a main power supply wire 30 at a terminal. The wire 31 includes a resistor 7 and a terminal that connects a signal wire 32 to the wire 31. The signal wire 32 also includes a resistor 8. The resistor 7 typically has more resistance than the resistor 8 which forces a signal through the resistor 8 and towards the logic circuitry 5 via the signal wire 32.

The filter 4 also includes a jumper wire 33 that connects a component ground wire 34 to the signal wire 32. The jumper wire 33 includes a capacitor 9 that acts as a filter in the event that the switch 1 or 3 bounces once released from a depressed position.

The signal is carried to the logic circuitry 5 from the filter 4 through the signal wire 32. The signal wire 32 connects to an input terminal 21 on a logic chip 12 that is contained with the logic circuitry 5. Power is supplied to the logic chip 12 through a power supply wire 35 that connects to the main power supply wire 30 at a terminal. The power supply wire 35 includes a diode 11 which allows current to flow from the main power supply wire 30 to the power supply 35 while preventing current from flowing in a reverse direction.

A capacitor 10 is positioned in the power supply wire 35 between the diode 11 and the ground line 34. The capacitor 10 also acts as a filter in the event of either a switch 1 or 3 inadvertently bouncing.

A logic chip power supply wire 36 connects to the power supply wire 35 and supplies power to a power terminal 22 on the logic chip 12. With power supplied to the logic chip 12, the logic chip 12 is responsive to the signal transmitted through the signal wire 32. The logic chip 12 preferably includes a flip flop switch that provides an output signal to an output terminal 20. When the power is interrupted by depressing either the switch 1 or 3 with manual force and then released, the switch 1 or 3 completes the circuit and the flip flop switch changes the state of the output signal.

The output signal is carried along the signal transmission wire 36 which connects the output terminal 20 of the logic chip 12 to an input terminal 18 on the light source switch 13. The logic chip 12 also includes a ground terminal 19 that connects to the component ground wire 34 with a ground wire 37.

The light source switch 13 receives the signal from the logic chip 12 and changes a state of the light source switch 13 to either provide power to the light source 14 or to disrupt power to the light source 14. Power is supplied to the light source 14 through the main power supply wire 30 which terminates at the power input terminal 15 on the light source switch 13. A ground wire 38 is attached to a ground terminal 17 where the ground wire 38 connects the light source switch 13 to the component ground wire 34.

The signal from the logic chip 12 changes the state of the light source switch 13 to either supply power to the light source 14 through a power supply wire 39 which is connected to a power output terminal 16 of the light source switch 13 or to disrupt power from the power output terminal 16 to the light source 14. The light source switch 13 is typically a metal oxide semiconductor field effect transistor (MOSFET) which changes its state from on or off or vice versa depending upon the signal received at the input signal terminal 13.

Power is supplied to the light source 14 through the power supply wire 39 to illuminate the light source 14 and provide light. The light source is typically a light emitting diode. However, other light source can also be utilized in the flashlight including, but not limited to, an incandescent light and high intensity discharge lights.

The circuit is completed by connecting a ground wire 40 attached to the light source 14 to a main ground wire 42 which connects to the power source 2. The ground wires 34 and 38 connect at a terminal along with a ground wire 41. The ground wire 41 connects to the main ground wire 42 to complete the circuitry for the filter 4, the logic circuit 5, and the switch for the light source 6.

The power source 2 is typically a dry cell battery. Typically, two or more dry cell batteries are contained within the main body of the flashlight 51. However, the flashlight 57 may also require only one dry cell battery.

Figure 4:
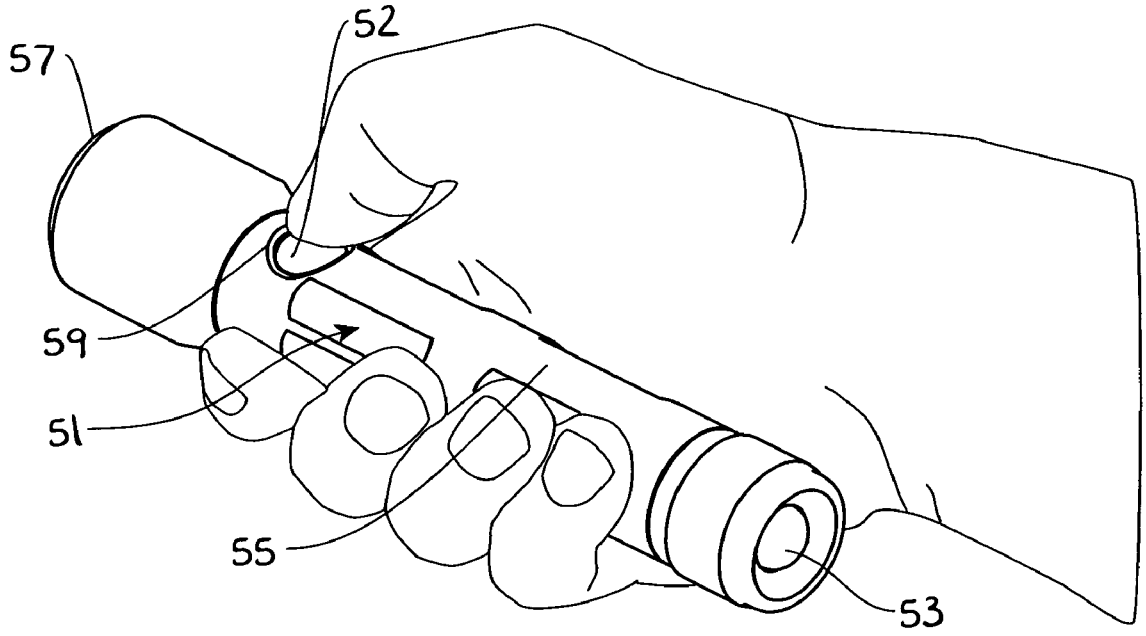
FIG. 4 is a perspective view of the flashlight of the present invention being gripped by a hand and utilizing the switch proximate the light emitting source.

Referring to FIG. 4, because of the circuitry within the flashlight 51 allows either switch 1 or 3 to be utilized to energize or disrupt power to the light source 14, the flashlight 51 can be utilized by positioning the flashlight main body 52 within the user's hand such that the thumb is proximate the side switch is 52. With the thumb proximate the side switch 52, the user depresses the side switch 52 to either supply power to the light emitting source 57 or to de-energize the light emitting source 57. Holding the flashlight 5 in the hand as illustrated in FIG. 4 allows the user to utilize the flashlight at about waist level or with the arm extended in an extended position below shoulder level.

Figure 5:
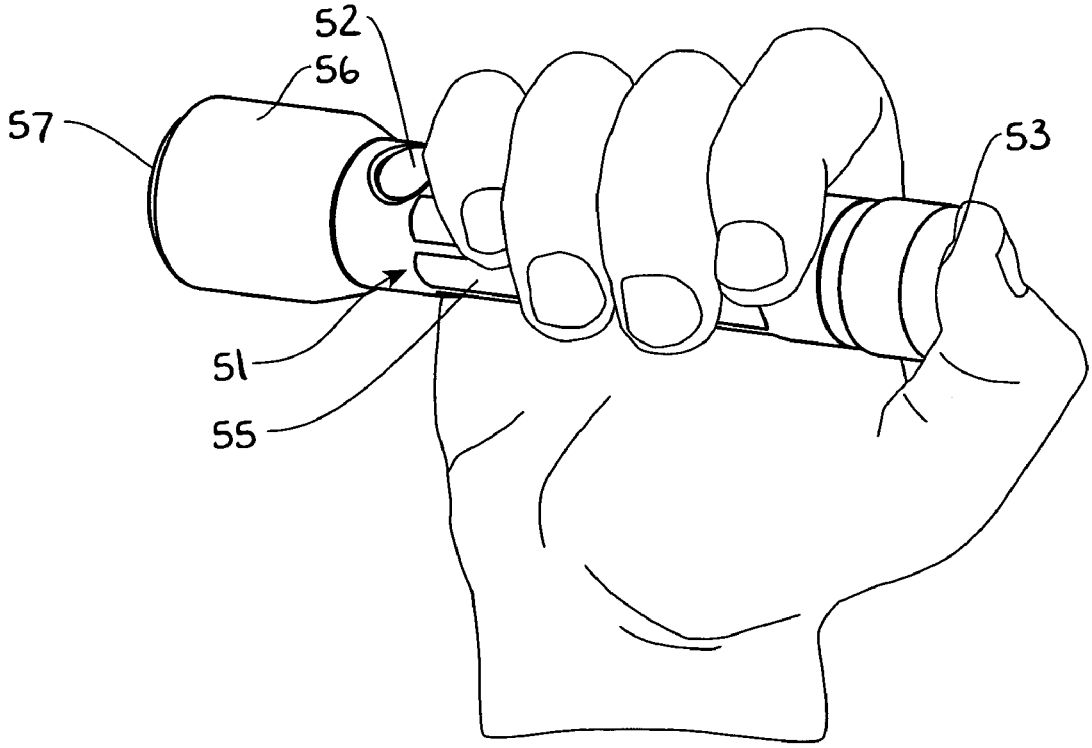
FIG. 5 is a perspective of the flashlight of the present invention being gripped by a hand and utilizing a switch in the tail cap of the flashlight.

Referring to FIG. 5, the flashlight 51 can also be positioned in another grip within the user's hand such that the thumb engages the tail switch 53. Utilizing this grip allows the user to energize or de-energize the light emitting source 57 while holding the flashlight near the shoulder with a bent arm, or in a higher position relative to the user's body. This allows the user to energize or de-energize the light emitting source 57 while the flashlight 57 is positioned at higher positions relative to the user.

Although the present invention has been described with reference to preferred embodiments, workers skilled in the art will recognize that changes may be made in form and detail without departing from the spirit and scope of the invention.

What is claimed is:

1. A hand held flashlight comprising:

a main body having a first end and a second end;

a power source within the main body;

a light emitting source attached to the main body proximate the first end of the main body;

a first switch operably attached to the main body proximate the second end of the main body;

a second switch operably attached to the main body between the first end and the second end; and circuitry within the main body that contains the first and second switches, a logic chip and a filter, the filter is positioned between the logic chip and the first and second switches and wherein the filter prevents an unintended power interruption when either the first or second switch bounces when released from a depressed position and wherein the circuitry connects the power source to the light emitting source through either the first switch or the second switch or both the first and second switches such that either the first or second switch can be manipulated independent of the position of the other switch to provide power to the light emitting source or interrupt power to the light emitting source.

2. The flashlight of claim 1 and wherein the first switch and the second switch comprise momentary switches wherein when either the first switch or the second switch is activated, a momentary interruption in the power supply occurs resulting in the circuitry supplying or interrupting power to the light emitting source.

3. The flashlight of claim 1 and wherein the logic chip detects an interruption in the power supply wherein the logic chip toggles between a configuration that sends a signal to supply power to the light emitting source or a configuration that sends a signal to interrupt power to the light emitting source.

4. The flashlight of claim 3 and wherein the circuitry further comprises a light source switch that receives the signal from the logic chip and depending upon the signal received from the logic chip, the light source switch either supplies power to the light emitting source or interrupts power to the light emitting source.

5. The flashlight of claim 1 and wherein the light emitting source comprises at least one light emitting diode.

6. The flashlight of claim 1 and wherein the power source comprises at least one dry cell battery.

7. The flashlight of claim 1 and wherein the main body is constructed of a material that conducts electricity.

8. The flashlight of claim 1 and wherein the main body is constructed of a non-conductive material that contains a ground path therein.

9. A hand held flashlight comprising:

a main body having a first end and a second end;

a power source within the main body;

a light emitting source attached to the main body proximate the first end of the main body;

a first momentary switch operably attached to the main body; and circuitry within the main body comprising the first momentary switch, a logic chip and a filter wherein the filter is positioned between the logic chip and the first momentary switch and wherein the filter prevents an unintentional interruption when the first momentary switch bounces when released from a depressed position and wherein the circuitry connects the power source to the light emitting source through the first momentary switch to provide power to the light emitting source or interrupt power to the light emitting source.

10. The flashlight of claim 9 and further comprising a second momentary switch attached to the main body a distance from the first momentary switch wherein the second momentary switch is contained within the circuitry such that the filter is positioned between the second momentary switch and the logic chip.

11. The flashlight of claim 10 and wherein the circuitry connects the power source to the light source through either the first momentary switch or the second momentary switch or both the first and second momentary switches such that either the first or second momentary switch can be manipulated independent of the position of the other switch to provide power to the light emitting source or to interrupt power to the light emitting source.

12. The flashlight of claim 9 and wherein the logic chip detects an interruption in the power supply wherein the logic chip toggles between a configuration that supplies power to the light emitting source to a configuration that interrupts power to the light emitting source.

13. The flashlight of claim 12 and wherein the circuitry further comprises a light source switch that receives the signal from the logic chip and depending upon the signal received from the logic chip, the light source switch either supplies power to the light emitting source or interrupts power to the light emitting source.

14. The flashlight of claim 9 and wherein the light emitting source comprises at least one light emitting diode.

15. The flashlight of claim 9 and wherein the power source comprises at least one dry cell battery.

16. The flashlight of claim 9 and wherein the main body is constructed of a material that conducts electricity.

17. The flashlight of claim 9 and wherein the main body is constructed of a non-conductive material that contains a ground path therein.

* * * * *